United States Patent [19]

Ruff

[11] Patent Number: 4,642,026

[45] Date of Patent: Feb. 10, 1987

[54] CENTRIFUGAL COMPRESSOR WITH ADJUSTABLE DIFFUSER

[76] Inventor: John D. Ruff, 206 Birch St., Alexandria, Va. 22305

[21] Appl. No.: 591,577

[22] Filed: Mar. 20, 1984

Related U.S. Application Data

[63] Continuation-in-part of Ser. No. 517,421, Jul. 26, 1983, abandoned.

[51] Int. Cl.[4] ..... F04D 29/46

[52] U.S. Cl. ..... 415/150; 415/211

[58] Field of Search ..... 415/148, 150, 160–162, 415/164, 211, 181

[56] References Cited

U.S. PATENT DOCUMENTS

| | | | |
|---|---|---|---|
| 916,156 | 3/1909 | Huguenin | 415/148 |
| 2,648,195 | 8/1953 | Wilde et al. | 415/161 UX |
| 2,797,858 | 7/1957 | von der Nuell | 415/148 |
| 2,985,427 | 5/1961 | Houghton | 415/164 |
| 3,069,070 | 12/1962 | Macaluso et al. | 415/148 |
| 4,325,673 | 4/1982 | Hall, Jr. | 415/211 X |
| 4,371,310 | 2/1983 | Henry, IV et al. | 415/211 |

FOREIGN PATENT DOCUMENTS

| | | | |
|---|---|---|---|
| 598956 | 5/1960 | Canada | 415/164 |
| 302588 | 4/1924 | Fed. Rep. of Germany | 415/211 |
| 659211 | 4/1938 | Fed. Rep. of Germany | 415/211 |
| 1096536 | 1/1961 | Fed. Rep. of Germany | 415/181 |
| 161999 | 12/1980 | Japan | 415/164 |
| 762254 | 11/1956 | United Kingdom | 415/211 |

*Primary Examiner*—Robert E. Garrett
*Assistant Examiner*—Joseph M. Pitko
*Attorney, Agent, or Firm*—Epstein & Edell

[57] ABSTRACT

A centrifugal gas compressor includes a centrifugal impeller and a diffuser with control vanes which pivot about their leading edges. The radially inward-facing surfaces of the control vanes are curves with a radius of curvature substantially equal to the radial spacing of the leading edges from the impeller rotation axis. In the closed vane position, each leading edge is overlaid by a trailing edge of an adjacent vane so that a closed annular wall blocks all outflow. One or more diffuser vanes may be fixedly positioned with respect to each control vane so as to pivot with the control vanes. The diffuser vanes are positioned radially outward from the control vanes and define respective gradually widening paths to diffuse the outflowing gas. As an alternative to diffuser vanes, the control vanes may be extended in length to define the widening paths between adjacent control vanes.

18 Claims, 11 Drawing Figures

CENTRIFUGAL COMPRESSOR WITH ADJUSTABLE DIFFUSER

CROSS REFERENCE TO RELATED APPLICATIONS

This application is a continuation-in-part of my copending U.S. patent application Ser. No. 06/517,421, now abandoned filed July 26, 1983 and entitled "Variable Capacity Centrifugal Compressor". The subject matter of that application is expressly incorporated herein, in its entirety, by this reference.

BACKGROUND OF THE INVENTION

I. Technical Field

The present invention relates to centrifugal compressors and, more particularly, to an improved diffuser structure for such compressors which permits efficient compressor operation over a wide range of flow rates.

II. Discussion of the Prior Art

When centrifugal gas compressors are operated at less than full capacity, there is a tendency to produce surges in the rate of flow through the compressor. It is known in the prior art to employ positionally adjustable diffuser vanes, for different loading conditions, to vary the width of the flow passages defined between the vanes. Examples of positionally adjustable diffuser vanes of this type may be found in the following U.S. Pat. Nos. 908,227 (Elling); 916,156 (Huguenin); 2,392,200 (Thompson); 2,645,410 (Bauger et al); and 3,799,694 (Duzan). When such diffuser vanes are employed, gas flow between the vanes emerges as separate high velocity streams spaced by relatively low flow inactive regions. The interaction between the high velocity streams on the one hand and the relatively inactive gas on the other hand results in considerable turbulence. This turbulence significantly reduces operating efficiency and produces undesirable noise, particularly at low capacity positional settings of the vanes. Certain prior art attempts to eliminate the pockets of inactive gas between egressing streams involve the use of wedge-shaped vanes, wherein the thick trailing vane edges occupy spaces otherwise filled by inactive gas pockets. While this approach has achieved some success in eliminating turbulence, individual gaseous streams nevertheless pass into the discharge region. This tends to be less efficient than when the discharge region receives completely diffused outflowing gas.

Another problem concerning positionally adjustable vane diffusers in prior art centrifugal compressors is found at low outflow rate settings. In order to prevent uncontrolled surging, it is desirable that passages between overlapping vanes be reduced in size such that a high velocity flow of gas is maintained even though the mass flow rate of the gas is decreased. In conventional centrifugal compressors there is no provision for maintaining the high gas velocity at reduced mass flow rates, and therefore uncontrolled surges often result.

Some prior art centrifugal compressors, in order to effect positional adjustment of the vanes, attempt to pivot the vanes about respective axes which pass through the leading edges of the vanes. More particularly, if each vane pivots about its leading edge, the leading edge remains at a constant distance from the impeller throughout the entire range of vane movement. However, no prior art device has been able to achieve precise coincidence of the pivot axes and the vane leading edges, and the axes of the load bearing shafts supporting the movable vanes. Therefore, the leading edges of the vanes in most prior art compressors move radially to some extent when the vanes are pivoted.

Finally, it is desirable to provide a fully closed position of the adjustable vanes, wherein substantially no gas is permitted to flow from the impeller, past the vanes, to the outflow or discharge region. In such a mode, the impeller can be driven but, without a flow path for the gas, there is no kinetic load on the compressor; rather, the impeller merely recirculates gas in an annular path at the impeller periphery. This mode is ideal for minimizing start-up power requirements and also allows the compressor to run indefinitely in an unloaded standby condition. However, many positionally adjustable vane diffusers are not capable of effecting a substantial closure of the flow path between the impeller and the diffuser discharge outlet. Those that can present an uneven surface in the annular re-circulation region which creates considerable drag on the recirculating flow and a resulting load on the impeller.

OBJECTS AND SUMMARY OF THE INVENTION

It is therefore an object of the present invention to provide a centrifugal compressor with a pivotable vane diffuser constructed to eliminate generation of separate spaced streams and to permit complete diffusion of the gas passing between the vanes. It is another object of the present invention to provide a centrifugal compressor having a diffusion control vane assembly which effectively spreads high velocity gas flows into the otherwise inactive areas of the diffuser distribution region to effect even gas distribution. Another object of the present invention is to provide a centrifugal compressor with pivotable diffusion control vanes which pivot precisely about the leading edges of the vanes. A further object of the present invention is to provide a centrifugal compressor with a diffuser control vane assembly that can be closed to substantially block any outflow from the impeller to the diffuser while eliminating drag on gas which is recirculated by the impeller.

A still further object of the present invention is to reduce the width of the passages between diffuser vanes for low loading conditions in a centrifugal compressor so that a high velocity gas flow can be maintained even though the mass flow rate is decreased.

In accordance with the present invention a centrifugal compressor is provided with a series of control vanes which are arranged in an annular path about the impeller rotation axis and which are pivotable about respective axes passing through the leading edges of the vanes. Each vane has a radially inward facing surface section having a radius of curvature substantially equal to the radial spacing between the impeller rotation axis and the pivot axes of the control vanes. In a fully closed position of the control vanes, these surface sections form a continuous annular wall having a constant radius of curvature to block outflow while presenting no discontinuities that could cause drag on the gas which is recirculated by the impeller along that annular wall. Each control vane preferably includes a trailing edge which overlies and seals against the radially outward facing surface of an adjacent control vane.

In order to eliminate the inactive gas regions between flows through the control vanes, a plurality of diffuser vanes are provided radially outward from the control vanes. Each diffuser vane is secured to a respective control vane by means of a streamlined strut and therefore pivots as its associated control vane pivots. The diffuser vanes define gradually widening passages with the radially outward facing surfaces of their control vanes and thereby spread the high velocity flows, which are received from between the control vanes, into the areas which would otherwise contain inactive gas. The result is a substantially complete diffusion of the gas and elimination of separate or independent streams. Further smoothing or diffusion of the outflow can be achieved by adding additional rings of diffuser vanes with each vane secured to a radially inner vane, whereby positioning of each control vane controls the position of plural radially outer diffuser vanes.

As an alternative to using diffuser vanes, each control vane may have its trailing edge extended to overlap a greater length of the adjacent control vane. The mutually presented surfaces of the overlapping control vane portions define a gradually widening passage which efficiently distributes the flow in the diffuser outlet region.

BRIEF DESCRIPTION OF THE DRAWINGS

These and other objects, features and many of the advantages of the present invention will be better understood from the following detailed description considered in connection with the accompanying drawings wherein like parts in each of the several figures are identified by the same reference numerals, and wherein.

DESCRIPTION OF THE PREFERRED EMBODIMENTS

Figure 1:
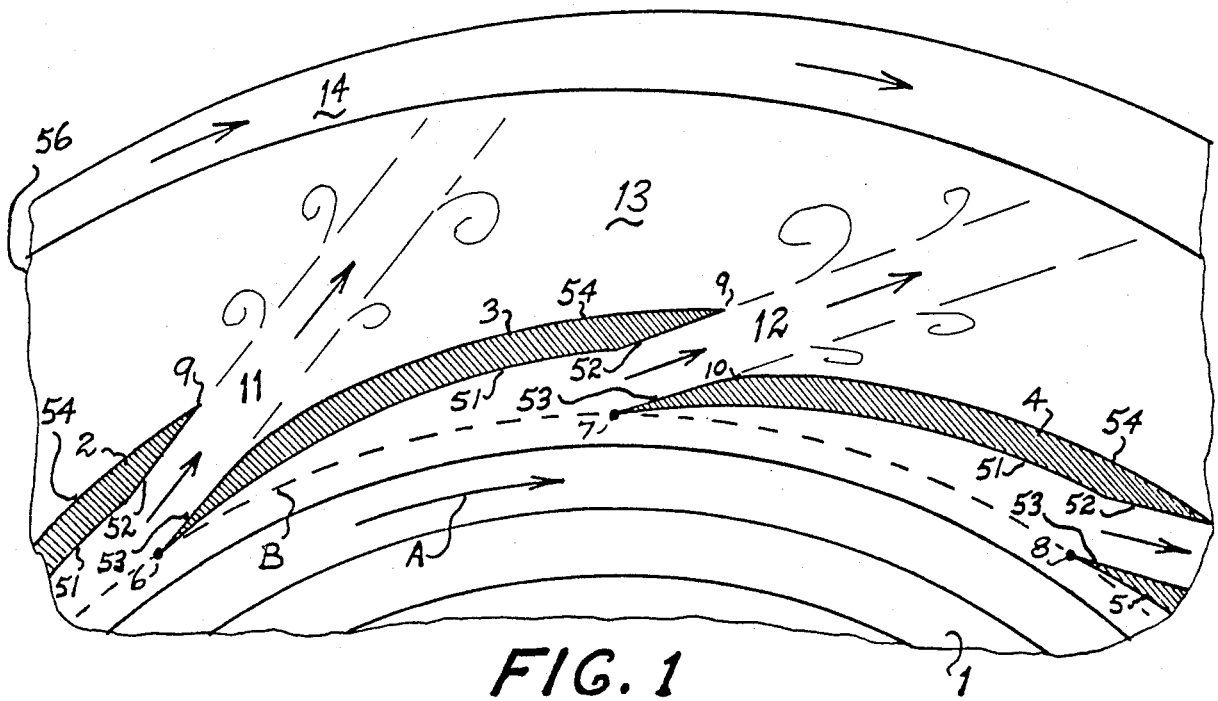
FIG. 1 a partially diagrammatic cut-away view in elevation of a diffuser section of a centrifugal compressor constructed in accordance with the present invention.

Referring specifically to FIG. 1 of the accompanying drawings, a centrifugal compressor includes an impeller 1 which rotates about an axis (not shown) in a direction represented by arrow A, which is clockwise in FIG. 1. The impeller rotation axis extends perpendicular to the plane of the drawing and defines the radial center of both the impeller and an annular diffuser assembly located beyond the impeller periphery. In this regard, the outer periphery of the impeller is referred to in the present discussion; if an open impeller is used, the outer periphery is defined by the arc of travel of the tips of the open impeller blades. Impeller 1 is quite conventional and a more detailed illustration thereof may be found in my aforementioned U.S. patent application Ser. No. 06/517,421, now abandoned.

An annular diffuser passage or region 13 is defined beyond the outer periphery of impeller 1 between front wall 55 (not shown in FIG. 1, but shown in FIG. 3) and rear wall 56 of the compressor. Diffuser passage 13 delivers diffused gas flow to volute 14 which in turn passes the flow to the compressor discharge outlet (not shown).

A plurality of control vanes 2, 3, 4, 5, etc., are arranged in a ring about the periphery of impeller 1 between walls 55 and 56 to bridge passage or region 13. Although only four control vanes are illustrated, it is understood that there are additional control vanes provided to complete the ring of vanes about the impeller. Control vanes 3, 4, 5 are illustrated as having leading edges 6, 7, 8, respectively, which are pivotably mounted about respective control axes positioned coaxially with the leading edges. The leading edges 6, 7, 8, as well as the leading edges/control pivot axes of the other control vanes, are disposed at equal radial distances from the impeller rotation axis and extend parallel to that rotation axis. The dashed line B in FIG. 1 represents the circular path defined by the spaced leading edges of the control vanes.

The radially inward-facing surface of each control vane is sub-divided into two angularly-extending sections 51 and 52. Concave section 51 extends rearwardly from the leading edge of the vane and has a radius of curvature substantially equal to the radius of circular path B. In practice, a slight allowance must be made for operating clearance between the vanes, but for present purposes, the radius of curvature of surface section 51 can be considered equal to the radius of path B. Surface section 52 extends rearwardly from section 51 to the trailing edge 9 of the control vane and is substantially planar, extending outwardly at an angle to section 51. The radially outward-facing surface of each control vane includes a substantially straight portion 53 extending angularly from the vane leading edge. A convex second surface portion 54 intersects portion 53 at a straight line 10 and extends angularly to the trailing edge 9 of the vane. The actual contour of portion 54 is not critical for the embodiment of FIG. 1 but is preferably arcuate with a radius of curvature slightly greater than that of surface section 51. It will be seen that the leading edges of the control vanes are defined by the intersection of surface section 51 and surface portion 53. Likewise, trailing edge 9 is defined by the intersection of surface section 52 and surface portion 54.

In the preferred embodiment of the invention, the control vanes 2, 3, 4 and 5 are mechanically coupled so as to be pivotable together. However, the vanes may be individually pivotable or pivotable in selected groups. Pivoting of the control vanes about their leading edges varies the capacity of the compressor unit while maintaining the leading edges of the vanes in a fixed spacing relation with respect to the impeller 1. For minimum compressor capacity the control vanes are pivoted until the trailing edge of each vane is closely spaced from and nearly touches the intersection 10 between portions 53 and 54 in the radially outward-facing surface of the next adjacent vane in the direction A of impeller rotation. In this regard, the angular length of surface section 51 is chosen to be substantially equal to the angular spacing between successive control pivot axes or leading edges 6, 7, 8, etc., so that surface section 52 extends angularly beyond the leading edge of the next control vane in the sequence. Passages for outflows 11, 12, etc., of gas which is centrifugally impelled from impeller 1 are defined between control vane surface section 52 and the surface portion 53 of the next vane in the sequence.

It is also possible to shut off flow completely, while the impeller continues to rotate, by pivoting the control vanes until surface section 52 of each control vane actually touches and makes flush contact with the surface portion of the adjacent control vane. This establishes a fully unloaded idling function of the compressor. In this position, the surface sections 52 of the control vanes form an impeller-encircling barrier along path B to prevent passage of gas from the impeller to the diffuser. The barrier extends through leading edge axes 6, 7, 8, etc., and is concentric with the periphery of impeller 1. This is an advantageous feature since such a concentric circular barrier offers a minimum resistance to recirculating flow in the idling mode.

When greater compressor capacity is required, the control vanes are pivoted so that the trailing edges 9 and surface sections 52 are moved away from surface portions 53 of adjacent control vanes. This permits a greater flow of gas through the control vanes to diffusion distribution region 13.

The compressor as described thus far is a single stage compressor. For multiple stage compressor systems, each stage is considered to be an individual compressor unit, and the invention as described herein may be applied to each stage individually.

The illustrated position of the control vanes 2, 3, 4, etc., in FIG. 1 is typical of a low capacity mode (for example, 10 percent of maximum load). The high velocity streams of flow 11, 12 between the control vanes 2, 3 and 3, 4, respectively, are localized, and a pocket of relatively low flow or inactive gas is provided between these streams in region 13. Eddying and turbulence in this pocket tends to cause some inefficiency and roughness in compressor operation. The interaction between streams 11, 12 and the inactive pocket takes place in the diffuser region of the compressor where high velocity gas from the impeller 1 should be diffused and reduced in velocity before flowing to volute 14 which directs the gas to the discharge port of the compressor. However, the high velocity streams 11, 12 tend to flow directly into volute 14 without sufficient diffusion, and some loss of efficiency results. These inefficiencies may be eliminated by means of the modification illustrated in FIGS. 2 and 3 to which specific reference is now made.

Figure 2:
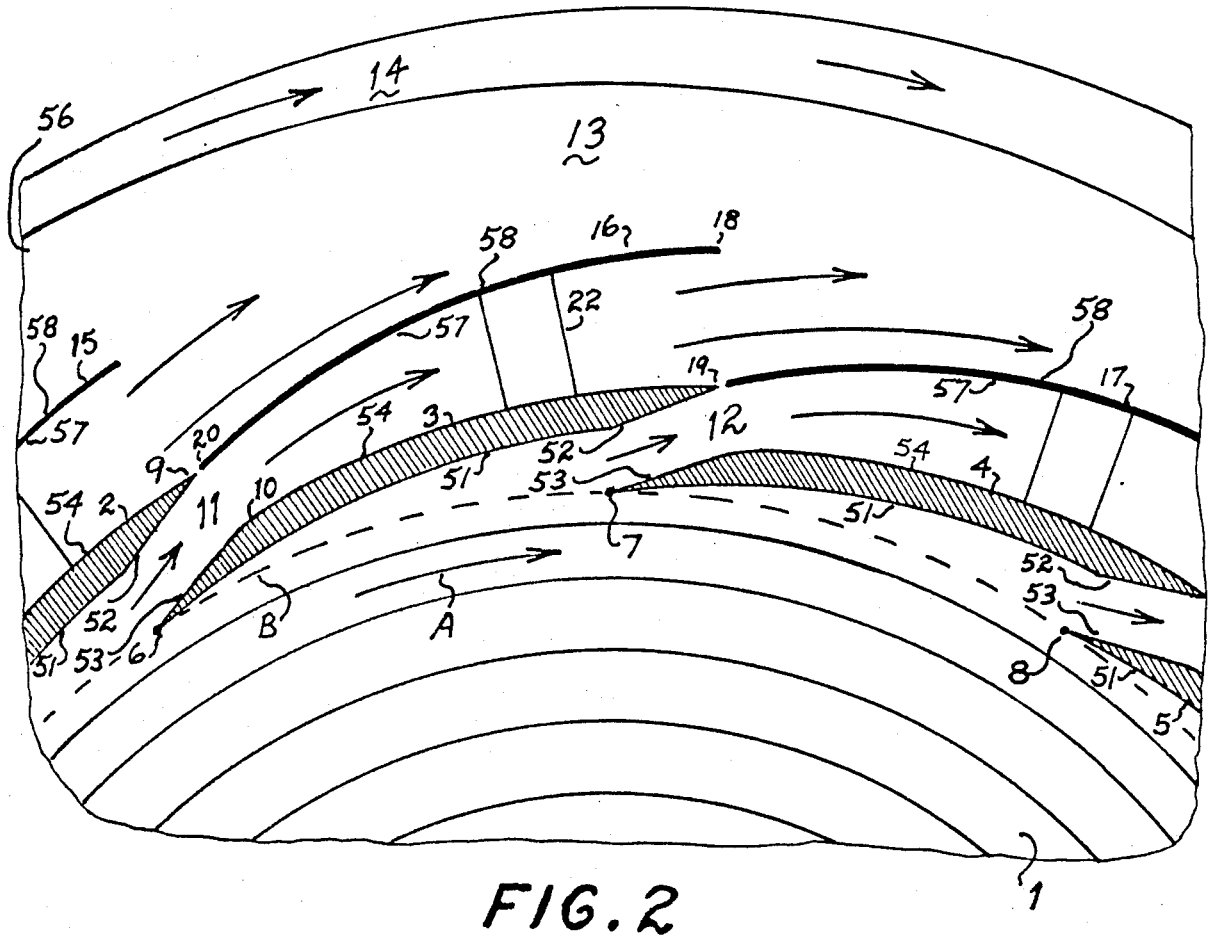
FIG. 2 is a view similar to FIG. 1 of a modified diffuser section constructed in accordance with the present invention.
Figure 3:
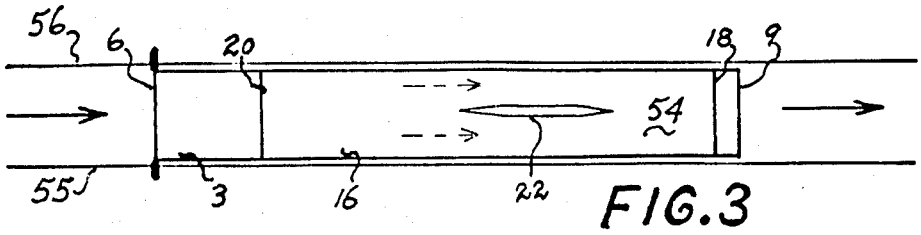
FIG. 3 is a top view in plan of a portion of the diffuser of FIG. 2.

The embodiment illustrated in FIGS. 2 and 3 includes the same control vanes 2, 3, 4, etc., but each control vane is operatively associated with a respective diffuser vane 15, 16, 17, etc. A similar diffuser vane is associated with each of the control vanes. Each diffuser vane 15, 16, 17, etc. is a radially thin sheet member which extends between compressor walls 55 (not illustrated in FIG. 2) and 56 to bridge the region 13. Each diffuser vane extends angularly at a location radially outward from its associated control vane and has a concave radially inward-facing surface 57 and a convex radially outward-facing surface 58. Each diffuser vane (for example, vane 16) is positionally fixed to and radially spaced from its associated control vane (for example, vane 3) by means of a streamlined strut member 22 which extends radially between the surface portion 54 of the control vane and surface 57 of the diffuser vane. The diffuser vanes are oriented to define a gradually widening flow passage between surface portion 54 and surface 57 in the direction of flow (for example, stream 11) through the vanes. Diffuser vane 16 acts to turn stream 11 and direct it to flow along outer surface portion 54 of control vane 3 so that the stream follows the controlled, gradually widening passage. The streams 11, 12, etc., therefore flow smoothly through the previously inactive pockets in passage 13. The gradually widening passage is established with the trailing edge 18 of diffuser vane 16 spaced at a greater distance from the trailing edge 9 of the control vane 3 than the spacing between leading edge 20 of the diffuser vane 16 from surface section intersection 10 of control vane 3. As the high velocity gas flows through this passage, its velocity is efficiently reduced. This wider stream of gas (at lower velocity) flows outwardly through region 13 where it mixes with similar streams flowing from the other diffuser vanes. The tendency towards eddying and turbulence in region 13 is reduced greatly by the presence of the diffuser vanes.

As noted above, all diffuser vanes are fixed positionally to associated control vanes by strut members 22 so that each diffuser vane rotates with its associated control vane as a unit. Strut 22 provides only one example of means for positionally fixing diffuser vanes to the control vanes; other suitable alternative means may be employed for this purpose.

Figure 4:
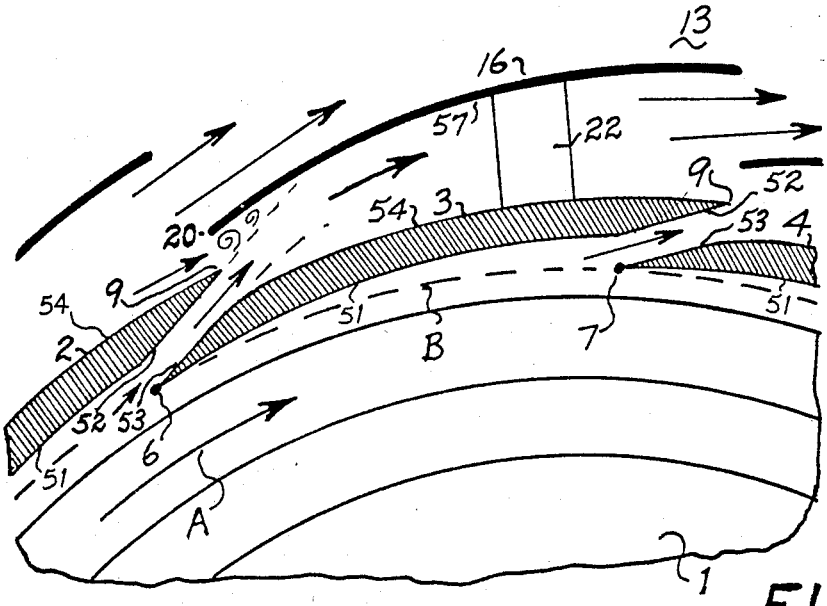
FIG. 4 is a view similar to FIG. 2 of a still further modified diffuser section constructed in accordance with the principles of the present invention.

The position of control vane 2 illustrated in FIG. 2 is such that its trailing edge 9 is aligned, in the direction of flow, with the leading edge 20 of diffuser vane 16. This alignment is an ideal condition; however, when capacity is adjustably reduced by pivoting the control vanes to a position such as that illustrated in FIG. 4, trailing edge 9 is no longer aligned with diffuser vane 16 and a small amount of eddying occurs radially inside diffuser vane 16 near the leading edge 20. Performance under these conditions is a little less than ideal but is still considerably better than if diffuser vanes were not employed. In its simplest form, this aspect of the present invention associates a single respective diffuser vane, positionally secured to and movable with each control vane, to improve flow efficiency at low compressor capacity. However, additional diffuser vanes may be employed, as described below.

Figure 5:
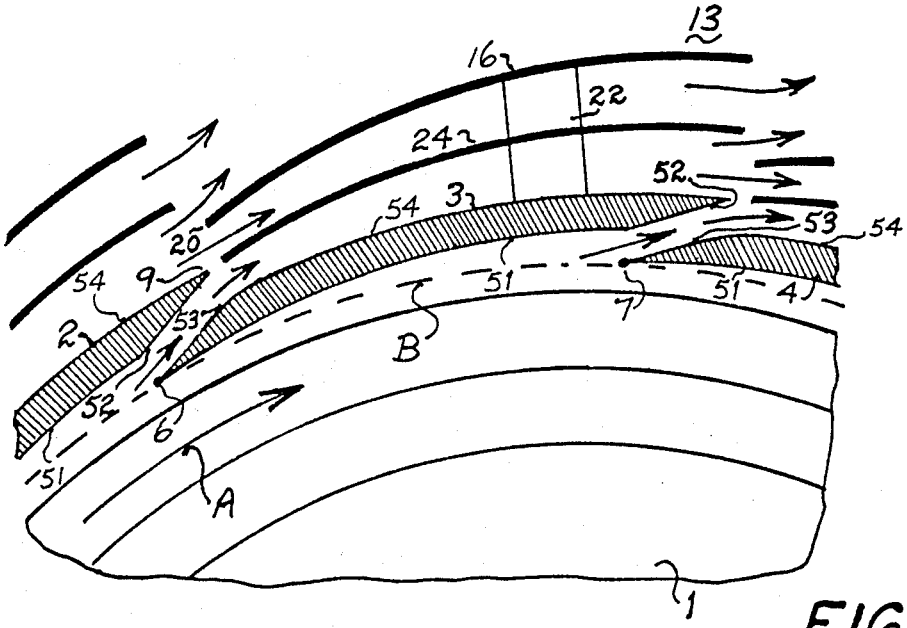
FIG. 5 is a view similar to FIG. 2 of another modified diffuser section constructed in accordance with the present invention.

An alternative embodiment is illustrated in FIG. 5 of the accompanying drawings and includes an additional diffuser vane 24 associated with each control vane and mounted on strut 22. Additional diffuser vane 24 is secured between control vane 3 and diffuser vane 16 to effect control of gas flow during very low capacity operation. Vane 24 separates the high velocity gas, flowing out of the opening between surface portion 53 and surface section 52 of adjacent control vanes, from the relatively slower moving gas which flows along the control vane surface portion 54 towards the leading edge 20 of the diffuser vane. Additional vane 24 thereby serves to prevent eddying and turbulence. The orientation and configuration of the additional diffuser vane 24 is such that the passage defined between it and control vane 3, and the passage defined between it and diffuser 16, both present gradually widening paths to gas flowing through them, thereby effecting a smooth velocity reduction.

Figure 6:
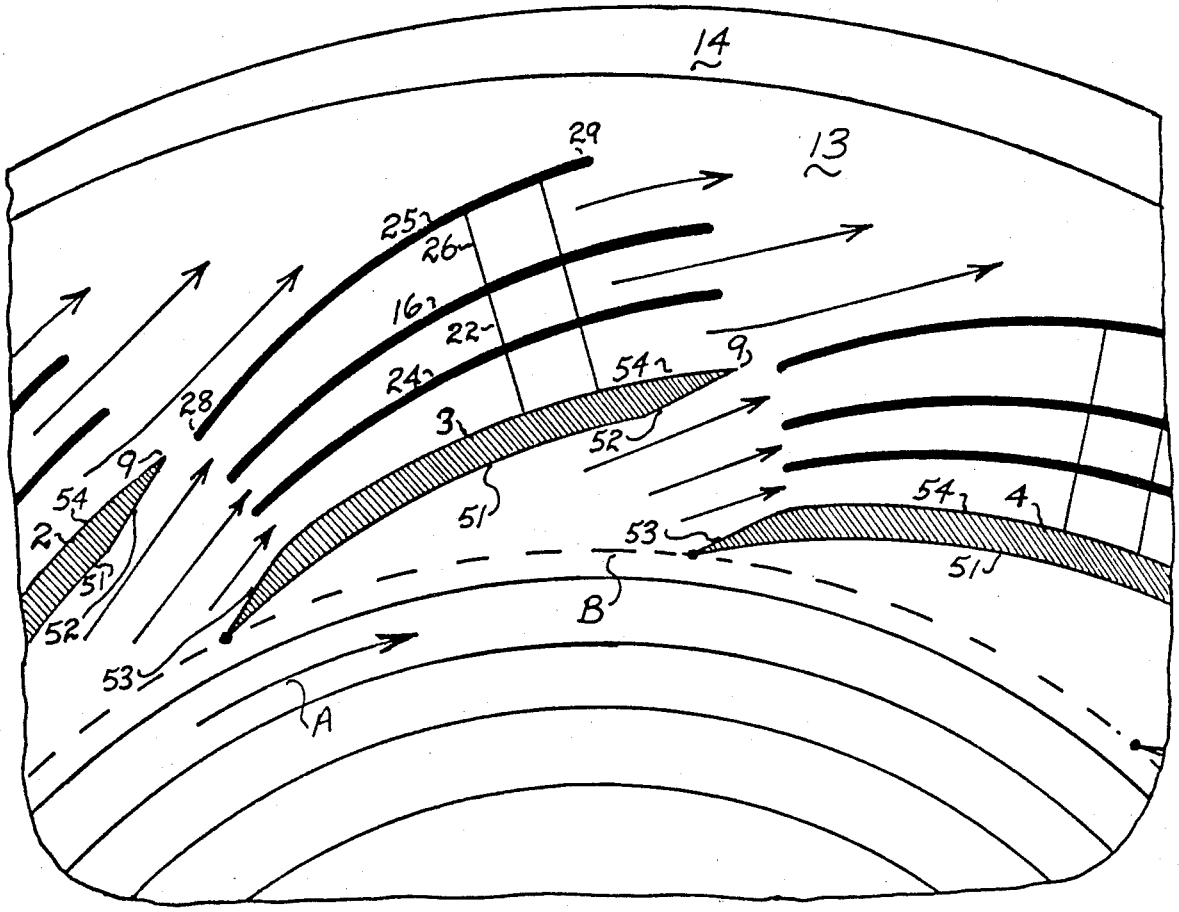
FIG. 6 is a view similar to FIG. 2 of another embodiment of the diffuser section constructed in accordance with the present invention.

When the compressor is operating at higher capacity, for example, as illustrated in FIG. 6, control vanes 2, 3, 4, etc. are opened further. At this position, trailing edge 9 of control vane 2 is aligned outside diffuser vane 16. An alternative arrangement of the present invention provides for mounting a still further diffuser vane 25 on a strut 26 extension of strut 22 to improve gas flow efficiency at higher capacity operation. Vane 25 separates the high velocity gas flowing out of the opening between control vane surface section 52 and adjacent control vane surface portion 53 from the relatively slower moving gas flowing along the outer surface portion 54 of the control vane 2 and diffuser vane 27. Vane 25 is mounted with its leading edge 28 spaced closer to diffuser vane 16 than the spacing between its trailing edge 29 and diffuser vane 16. This provides a gradually widening path for the gas flow and a smooth reduction in gas velocity is thereby achieved.

A primary advantage of the use of secondary diffuser vanes mounted on the backs of control vanes is that a permanently set widening diffuser path is presented to the high velocity gas flow. As the control vanes are opened to different settings, this widening diffuser path is not altered. Although at larger settings, additional flow can take place outside of the set diffuser path (i.e., through additional vanes, or directly through the diffuser area), the overall diffuser efficiency is maintained. Prior art systems do not employ secondary diffuser vanes attached to control vanes but instead rely only on primary control vanes. Such systems can be designed so that these primary control vanes form an ideal, widening diffuser path at low capacity settings; however, at larger capacity settings the degree of widening is not as great and not as efficient. As noted above, the problem of high velocity streams of gas causing turbulence in passing through relatively inactive pockets of gas is solved by the present invention by turning the streams of gas to spread them out through these inactive pockets.

I have described and illustrated the use of as many as three diffuser vanes attached to each control vane, as illustrated in FIG. 6. Even smoother flow throughout the full range of compressor capacities can be achieved by employing a still greater number of diffuser vanes with smaller distances between them. However, friction losses increase with the addition of each diffuser vane, and the ultimate in overall efficiency involves a tradeoff between these friction losses and losses due to turbulence. This then becomes a machine design consideration for each application.

Figure 7:
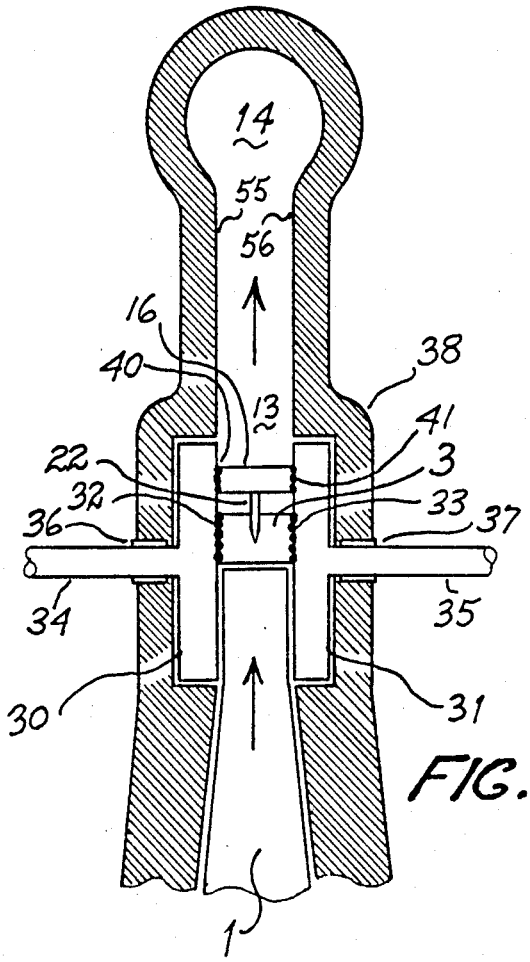
FIG. 7 is a cut-away view in section taken along lines 7—7 of FIG. 2.
Figure 9:
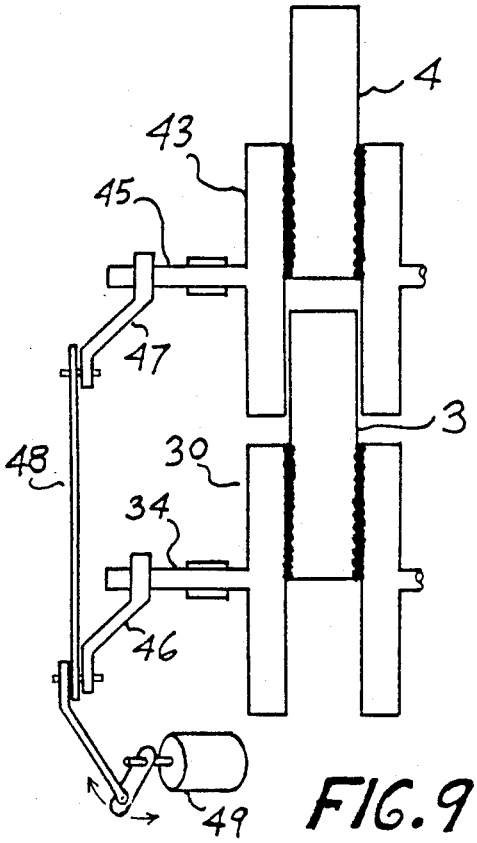
FIG. 9 is a schematic illustration showing how the various control vanes in the embodiment of FIGS. 7 and 8 are commonly controlled.
Figure 8:
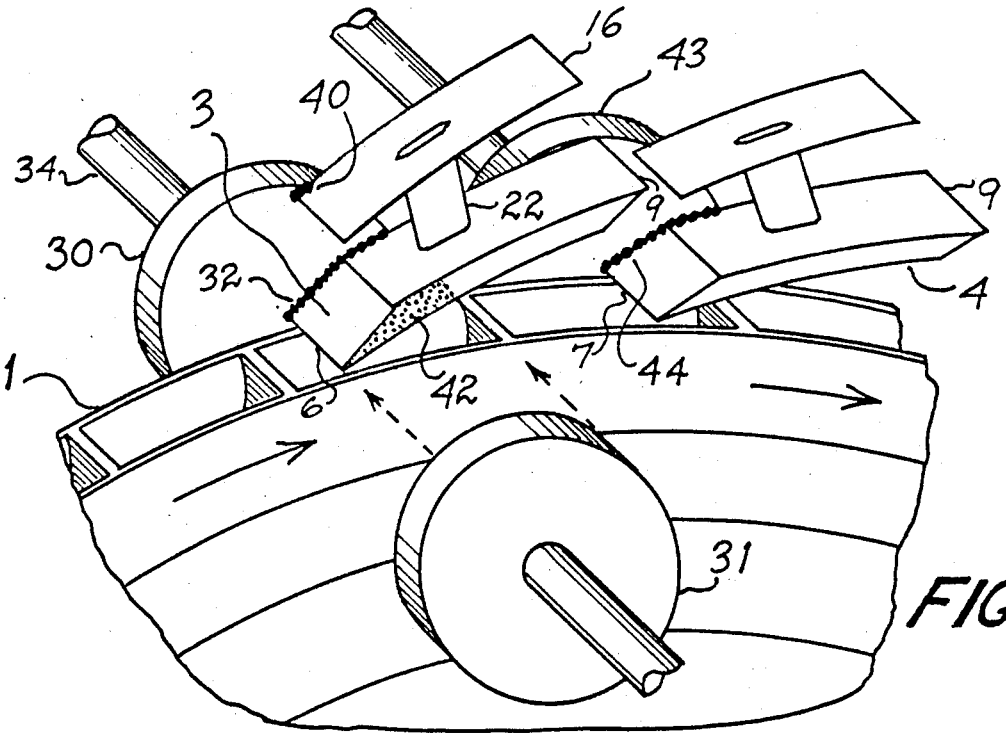
FIG. 8 is a cut-away view in perspective of the diffuser section embodiment of FIG. 2.

Mechanical details of suitable mechanisms for supporting and rotating the control vanes are illustrated in FIGS. 7, 8, and 9. Referring specifically to FIGS. 7 and 8, control vane 3 is attached to rotatable discs or turntables 30, 31 by means of welds 32 and 33. Discs 30, 31 are attached to rotatable shafts 34, 35. Therefore, shafts 34, 35, discs 30 and 31 and control vane 3 form a single rotatable assembly which rotates in bearings 36, 37 set into main compressor housing 38. The discs 30, 31 are recessed into housing 38 so that their inside surfaces, to which control vane 3 is welded, are flush with the inside surface of housing 38 in the regions of diffuser passage 13 and impeller 1. Gas can therefore flow from impeller 1 to diffuser passage 13 with minimal obstruction by discs 30, 31. However, discs 30, 31 must have diameters which are large enough so that they make adequate contact with control vane 3 and so that welds 32, 33 are strong enough to support control vane 3. Diffuser vane 16 is also welded to discs 30, 31 by welds 40, 41.

The view in FIG. 8 illustrates clearly how the leading edge of each control vane is positioned on the control vane pivot axis. Specifically, the side edges of the vane are secured to the disc surface with the leading edge of the vane disposed at the center of that disc surface. The control vane thus extends radially along the surface of the disc from the disc center. Adjacent control vane 7 with its supporting discs 43 is also shown in this view with its attachment weld 44. The use of welds 32, 33, 40, 41 and 44 is only one method of securing control vanes and diffuser vanes to the discs. Other methods may be employed, such as the use of slotted channels in the discs into which the vanes may be fitted. The vanes may also be brazed into these channels or secured by screws. Alternatively, the vanes and discs may be molded or otherwise machined as a single piece. Any conventional method of fabricating such a component may be employed. The important point is that the leading edges of the control vanes are disposed precisely at their pivot axes so that the leading edge remains fixed relative to the impeller rotation axis for all pivot positions of the control vane.

FIG. 9 illustrates disc 30 and adjacent disc 43 with its shaft 45. These discs control rotation of control vanes 3, 4, respectively. Control arms 46, 47 are attached to the shafts 34, 45 and coupling 48 interconnects these arms. Similar couplings connect similar control arms to simultaneously control the movement of all of the control vanes which encircle impeller 1. Activator motor 49 provides the motive power to position all of the control vanes simultaneously and may be controlled to any desired capacity setting manually, automatically or by appropriate input signal. Alternative methods of coordinating the rotation of the control vanes may also be employed, such as coupling gears, or any other suitable mechanical arrangement.

Figure 10:
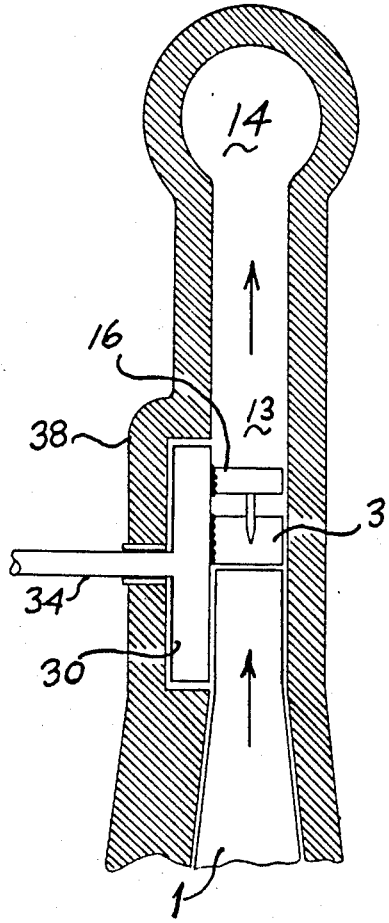
FIG. 10 is a view similar to FIG. 7 showing a modified construction of the apparatus for pivoting the control vane in the diffuser section.

An alternative method for supporting the control and diffuser vanes is illustrated in FIG. 10. This arrangement is similar to that shown in FIG. 7, except that the disc 31 is not employed and the control vane 3 and diffuser vane 16 are supported only by attachment to disc 30. Positioning of the vanes is still accomplished by rotation of shafts 34, 45, etc., as described hereinabove.

Figure 11:
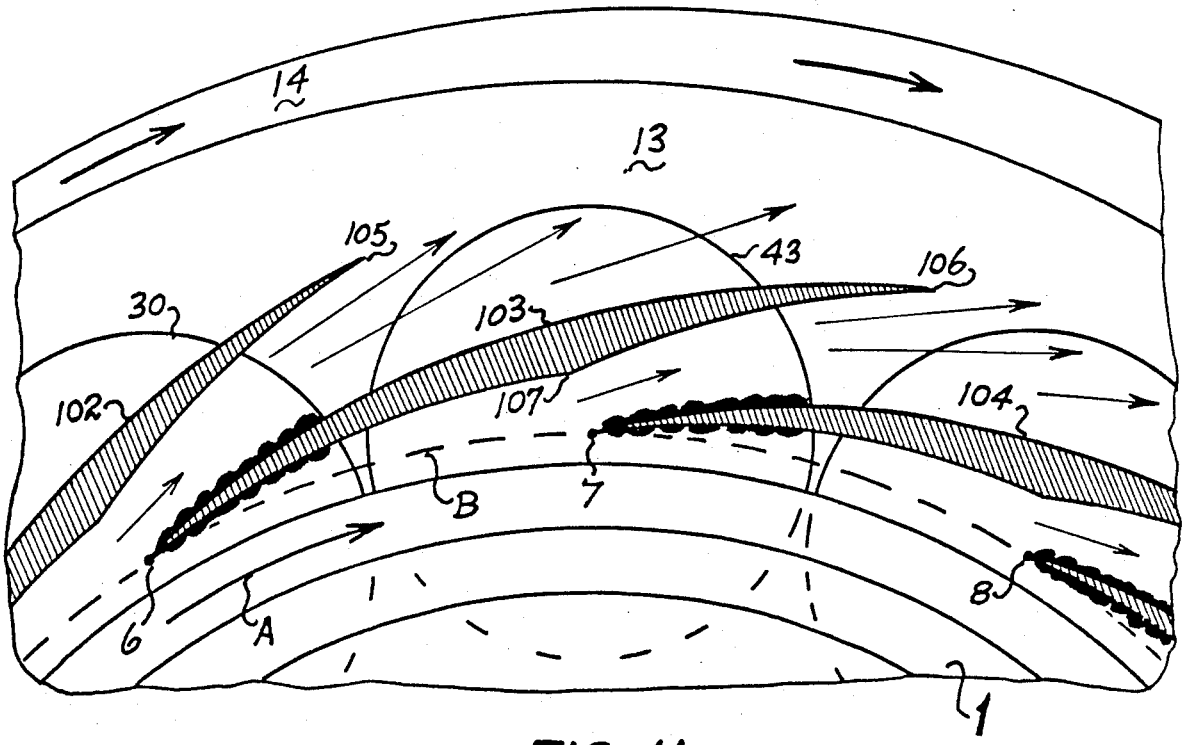
FIG. 11 is a view similar to FIG. 1 of a still further modified diffuser embodiment of the present invention.

An alternative arrangement for providing a gradually widening diffuser path, without the use of the diffuser vanes 16, etc., is illustrated in FIG. 11. Control vanes 103, 104 are secured to discs 30, 43 in the same manner described above with respect to control vanes 3 and 4. Control vanes 102, 103 have their trailing edges 105, 106 extending angularly further than the trailing edges 23, 19 of control vanes 2, 3 of the embodiment of FIG. 2. The inner surface of this extension is shown from point 107 to trailing edge 106 on vane 103. This inner surface combines with the outer surface of vane 104 to present a widening diffuser passage for gas flowing from impeller 1. The passage thus formed is similar in function to the passage formed by diffuser vane 17 and the outer surface of control vane 4 in the embodiment of FIG. 2. As discs 30, 43 are rotated for smaller or larger capacity operation, the passage width is varied, but always forms a widening passage for gas flow. Flow can also be shut off by bringing the vanes together, in the same manner as described above in relation to vanes 3, 4 and 5. Vane 103 is constructed with its thickness (in a radial sense) tapering off to a relatively sharp trailing edge 106. This provides a streamlined contour which reduces turbulence in the gas flowing past the vane. All of the vanes surrounding impeller 1 are similar in structure to vane 103.

The control vanes 102, 103, 104 in FIG. 11 each have a curved radially inward-facing surface section with a radius of curvature equal to the radial spacing of leading edges axes 6, 7, 8 from the axis of rotation of impeller 1. Therefore, when the control vanes are fully closed, these curved sections present a smooth concentric circular barrier to recirculating flow in the same manner as do vane sections 51 in FIG. 1. In addition, vanes 102, 103, 104 taper toward their trailing edges 105, 106, etc., to serve two functions. First, the radially inward-facing side of the trailing vane portion combines with the radially outward-facing side of the leading portion of the adjacent vane to define the desirable gradually widening flow passage for the centrifugally impelled fluid. Second, flow which egresses from this gradually widening passage is permitted to efficiently diffuse with one side of the flow guided by the trailing outwardly-facing side of one of the vanes. This permits smooth flow interaction at the trailing edge with the flow exiting from between the inward-facing side of that vane and the next vane.

Another modification of the present invention involves an alternative technique for coupling the control vanes. Rather than rotating all of the vanes of the compressor together, in some applications some of the control vanes may be rotated to positions which differ from the remaining control vane positions. For example, during minimum capacity operation, instead of opening all of the control vanes to a slight degree, certain selected vanes may be opened and the remainder kept closed. In this way, the lesser number of vanes which are open, are opened wider; and the overall losses due to friction are reduced. Separate motors can, for example, be employed to control the different groups of control vanes.

In describing the various diffuser vanes, mention has been made herein of a preferred configuration wherein the radial inward-facing surface (e.g., 57) is concave and the radially outward-facing surface (e.g., 58) is convex. It is to be understood that, for different embodiments and applications, the control vanes may be flat on both surfaces, or concave outwardly and convex inwardly, or irregularly shaped, etc. It is only important the the diffuser vanes be configured and positioned to cooperate with the control vanes and with each other to provide the gradually widening flow path required to effect complete diffusion of the contrifugally impelled fluid.

Having described several embodiments of a new and improved centrifugal compressor constructed in accordance to the present invention, it is believed that other modifications, variations and changes will be suggested to those skilled in the art in light of the above description. It is therefore to be understood that all such variations, modifications and changes are believed to fall within the scope of the present invention as defined by the appended claims.

I claim:

1. A centrifugal gas compressor including impeller means rotatable in a predetermined direction about a first axis for receiving and centrifugally impelling a gaseous medium, and annular diffuser means for receiving and diffusing the centrifugally impelled gaseous medium, said diffuser means comprising:

front and back walls extending substantially radially outward from said first axis in mutually spaced relation to define a passage for said centrifugally impelled gaseous medium;

a plurality of control vanes bridging said passage and disposed at angularly sequential locations about said first axis in said passage, each control vane having a radially inward-facing surface, a radially outward-facing surface, a leading edge, and a trailing edge, and oriented such that said leading edge faces opposite said predetermined direction and into the flow of gaseous medium which is centrifugally impelled by said impeller means, wherein said leading edge is a substantially linear intersection of said radially outward-facing surface and said radially inward-facing surface; and control means for pivoting said plurality of control vanes about a respective plurality of control axes between open and fully closed positions, each control axis being coaxial with the leading edge of a respective control vane, said control means including means responsive to application of rotational forces thereto for transmitting the applied rotational forces to said control vanes to effect rotation of said control vanes about said control axes wherein in said fully closed position the radially inward-facing surface of each control vane overlies and contacts the radially, outward-facing surface of an adjacent control vane in flush abutting relation.

2. The compressor according to claim 1 further comprising:

a plurality of diffuser vanes bridging said passage, there being at least one diffuser vane for each control vane; and support means for fixedly positioning each diffuser vane relative to a corresponding control vane at a location in said passage which is radially outward from said control vanes, said support means including a plurality of structural members extending radially from respective control vanes to respective diffuser vanes such that each diffuser vane pivots with the control vane to which it is fixedly positioned.

3. The compressor according to claim 1 wherein at least a section of the radially inward-facing surface of each control vane defines a respective flow path for the radially-impelled gaseous medium with a portion of the radially outward-facing surface of an adjacent control vane, each of said flow paths gradually widening in an angular direction corresponding to the direction of flow therein, wherein said section extends in said angular direction substantially beyond the leading edge of said adjacent control vane.

4. The compressor according to claim 1 wherein said control means comprises:

a plurality of rotatable members, there being at least one such rotatable member for each control vane, each rotatable member having a first surface facing axially into said passage and positioned flush with one of said front and back walls;

bearing means for supporting and rotating said rotatable members about respective rotational axes extending perpendicular to said first surfaces, each rotational axis corresponding to a respective one of said control axes; and means securing an axially-facing surface of each control vane to the first surface of a respective rotatable member with the leading edge of the control vane extending perpendicular to the first surface at the intersection of the control axis and said first surface.

5. A centrifugal gas compressor including impeller means rotatable in a predetermined direction about a first axis for receiving and centrifugally impelling a gaseous medium, and annular diffuser means for receiving and diffusing the centrifugally impelled gaseous medium, said diffuser means comprising:

front and back walls extending substantially radially outward from said first axis in mutually spaced relation to define a passage for said centrifugally impelled gaseous medium;

a plurality of control vanes bridging said passage and disposed at angularly sequential locations about said first axis in said passage, each control vane having a radially inward-facing surface, a radially outward-facing surface, a leading edge, and a trailing edge, and oriented such that said leading edge faces opposite said predetermined direction and into the flow of gaseous medium which is centrifugally impelled by said impeller means, wherein said leading edge is a substantially linear intersection of said radially outward-facing surface and said radially inward-facing surface; and control means for pivoting said plurality of control vanes about a respective plurality of control axes, each control axis being coaxial with the leading edge of a respective control vane, said control means including means responsive to application of rotational forces thereto for transmitting the applied rotational forces to said control vanes to effect rotation of said control vanes about said control axes;

wherein said control axes are angularly spaced at a common radial distance from said first axis, wherein the radially inward-facing surface of each control vane includes at least a first angularly extending section having a radius of curvature which substantially corresponds to said common radial distance, and wherein said control vanes are pivotable by said control means to a closed position in which the first sections are disposed end-to-end in an annular sequence to block radially outward flow through said passage.

6. The compressor according to claim 5 further comprising:

a plurality of diffuser vanes bridging said passage, there being at least one diffuser vane for each control vane; and support means for fixedly positioning each diffuser vane relative to a corresponding control vane at a location in said passage which is radially outward from said control vanes, said support means including a plurality of structural members extending radially from respective control vanes to respective diffuser vanes such that each diffuser vane pivots with the control vane to which it is fixedly positioned.

7. The compressor according to claim 5 wherein the radially inwardly-facing surface of each control vane includes a second section having a predetermined contour and which, in said closed position of said control vanes, overlies the leading edge and contacts a leading portion of the radially outward-facing surface of an angularly adjacent control vane, wherein said leading portion of said radially outward-facing surface is contoured to match said predetermined contour and permit flush contact between said leading portion and said second section of adjacent control vanes.

8. The compressor according to claim 7 wherein a trailing edge of each control vane defines one end of said second portion.

9. A centrifugal gas compressor including impeller means rotatable in a predetermined direction about a first axis for receiving and centrifugally impelling a gaseous medium, and annular diffuser means for receiving and diffusing the centrifugally impelled gaseous medium, said diffuser means comprising:

front and back walls extending substantially radially outward from said first axis in mutually spaced relation to define a passage for said centrifugally impelled gaseous medium;

a plurality of control vanes bridging said passage and disposed at angularly sequential locations about said first axis in said passage, each control vane having a radially inward-facing surface, a radially outward-facing surface, a leading edge, and a trailing edge, and oriented such that said leading edge faces opposite said predetermined direction and into the flow of gaseous medium which is centrifugally impelled by said impeller means, wherein said leading edge is a substantially linear intersection of said radially outward-facing surface and said radially inward-facing surface;

control means for pivoting said plurality of control vanes about a respective plurality of control axes, each control axis being coaxial with the leading edge of a respective control vane, said control means including means responsive to application of rotational forces thereto for transmitting the applied rotational forces to said control vanes to effect rotation of said control vanes about said control axes;

a plurality of diffuser vanes bridging said passage, there being at least one diffuser vane for each control vane; and support means for fixedly positioning each diffuser vane relative to a corresponding control vane at a location in said passage which is radially outward from said control vanes, said support means including a plurality of structural members extending radially from respective control vanes to respective diffuser vanes such that each diffuser vane pivots with the control vane to which it is fixedly positioned;

wherein each diffuser vane has a radially inward-facing surface which defines a gradually widening flow path for said gaseous medium with the radially outward-facing surface of the control vane to which each diffuser vane is positionally fixed.

10. The compressor according to claim 9 wherein each of said structural members is a strut disposed in a respective one of said gradually widening flow paths, said strut being streamlined to minimize turbulence in the gaseous medium flowing through the gradually widening flow path.

11. A centrifugal gas compressor including impeller means rotatable in a predetermined direction about a first axis for receiving and centrifugally impelling a gaseous medium, and annular diffuser means for receiving and diffusing the centrifugally impelled gaseous medium, said diffuser means comprising:

front and back walls extending substantially radially outward from said first axis in mutually spaced relation to define a passage for said centrifugally impelled gaseous medium;

a plurality of control vanes bridging said passage and disposed at angularly sequential locations about said first axis in said passage, each control vane having a radially inward-facing surface, a radially outward-facing surface, a leading edge, and a trailing edge, and oriented such that the leading edge faces opposite said predetermined direction and into the gaseous medium flow which is centrifugally impelled by said impeller means, wherein said leading edge is a substantially linear intersection of said radially outward-facing surface and said radially inward-facing surface;

control means responsive to application of rotational forces thereto for transmitting the applied rotational forces to said control vanes to effect rotation of said control vanes about respective control axes;

wherein the radially inward-facing surface of each control vane includes at least a first section extending angularly about said first axis from said leading edge and having a radius of curvature substantially corresponding to the spacing of said leading edge from said first axis; and wherein the radially inwardly-facing surface of each control vane includes a second section having a predetermined contour which, in said closed position of said control vanes, overlies the leading edge and contacts a leading portion of the radially outward-facing surface of an angularly adjacent control vane, wherein said leading portion of said radially outward-facing surface is contoured to match said predetermined contour and permit flush contact between said leading portion and said second section of adjacent control vanes.

12. The compressor according to claim 11 wherein at least a section of the radially inward-facing surface of each control vane defines a respective flow path for the radially-impelled gaseous medium with a portion of the radially outward-facing surface of an adjacent control vane, each of said flow paths gradually widening in an angular direction corresponding to the direction of flow therein, wherein said section extends in said angular direction substantially beyond the leading edge of said adjacent control vane.

13. The compressor according to claim 11 wherein each control axis is coaxial with the leading edge of a respective control vane.

14. The compressor according to claim 13 further comprising:

a plurality of diffuser vanes bridging said passage, there being at least one diffuser vane for each control vane; and support means for fixedly positioning each diffuser vane relative to a corresponding control vane at a location in said passage which is radially outward from said control vanes, said support means including a plurality of structural members extending radially from respective control vanes to respective diffuser vanes such that each diffuser vane pivots with the control vane to which it is fixedly positioned.

15. The compressor according to claim 14 wherein each diffuser vane has a radially inward-facing surface which defines a gradually widening flow path for said gaseous medium with the radially outward-facing surface of the control vane to which said each diffuser vane is positionally fixed, and wherein each of said structural members is a strut disposed in a respective one of said gradually widening flow paths, said strut being streamlined to minimize turbulence in the gaseous medium flowing through the gradually widening flow path.

16. A centrifugal compressor including impeller means rotatable in a predetermined direction about a first axis for receiving and centrifugally impelling a gaseous medium, and annular diffuser means disposed concentrically about said first axis for receiving and diffusing the centrifugally impelled gaseous medium, said diffuser means comprising:

front and back walls extending substantially radially outward from said first axis in mutually spaced relation to define a passage for said centrifugally impelled gaseous medium;

a plurality of movable control vanes bridging said passage and disposed at angularly sequential locations about said first axis in said passage, each control vane having a radially inward-facing surface, a radially outward-facing surface, a leading edge, and a trailing edge, and oriented such that said leading edge faces opposite said predetermined direction and into the flow of gaseous medium which is centrifugally impelled by said impeller means, wherein said leading edge is a substantially linear intersection of said radially outward-facing surface and said radially inward-facing surface;

a first plurality of diffuser vanes bridging said passage, there being at least one diffuser vane for each control vane; and support means for fixedly positioning each diffuser vane relative to a corresponding control vane at a location in said passage which is radially outward from said control vanes, said support means including a plurality of streamlined strut members extending radially from respective control vanes to respective diffuser vanes such that each diffuser vane is movable with the control vane to which it is fixedly positioned;

wherein each diffuser vane has a radially inward-facing surface which defines a gradually widening flow path for said gaseous medium with the radially outward-facing surface of the control vane to which each diffuser vane is positionally fixed.

17. The compressor according to claim 16 further comprising a second plurality of diffuser vanes bridging said passage, each of said second plurality of diffuser vanes being fixedly positioned relative to a respective diffuser vane in said first plurality of diffuser vanes.

18. The compressor according to claim 16 further comprising control means for pivoting said plurality of control vanes about a respective plurality of control axes, each control vane being coaxial with the leading edge of a respective control vane.

* * * * *